United States Patent [19]

Govan

[11] Patent Number: 4,943,249

[45] Date of Patent: Jul. 24, 1990

[54] LINE CUTTER FOR PROPELLERS

[76] Inventor: Donald T. Govan, Box 350246, Fort Lauderdale, Fla. 33335

[21] Appl. No.: 392,542

[22] Filed: Aug. 11, 1989

[51] Int. Cl.[5] ..... B63H 5/16

[52] U.S. Cl. ..... 440/73; 416/146 R

[58] Field of Search ..... 416/146 R, 146 B; 440/71, 73

[56] References Cited

U.S. PATENT DOCUMENTS

| | | | |
|---|---|---|---|
| 4,447,215 | 5/1984 | Govan | 440/71 |
| 4,507,091 | 3/1985 | Govan | 440/73 |
| 4,544,363 | 10/1985 | Govan | 440/73 |
| 4,801,281 | 1/1989 | Govan | 440/73 |

*Primary Examiner*—Sherman D. Basinger
*Attorney, Agent, or Firm*—Alvin S. Blum

[57] ABSTRACT

A device shears foreign matter such as lines, wires, nets, and weeds that can entangle and befoul propellers, propeller shafts, bearings and the like of propeller-driven sea-going vessels that are sheared by cooperative shearing action of rotating blades that rotate in conjunction with the propeller and at least one non-rotating blade mounted on a non-rotating portion of the vessel. Positioning mechanism maintains the non-rotating blade in proximity to the rotating blades, for effective shearing operation. The position of the propeller will change relative to the hull, advancing axially when under way in forward drive due to the forward thrust of the propeller and retreating in reverse. Heating and cooling of the shaft will also change propeller position. The positioning mechanism senses the propeller location and moves the non-rotating blade to accomodate changes in propeller position to maintain a fixed, very close spacing between the two blades to enable them to shear foreign matter caught between them. A damping mechanism retards sudden movement. A secondary moving mechanism causes the two blades to come closer together at the moment of shearing to overcome forces that tend to push them apart.

35 Claims, 8 Drawing Sheets

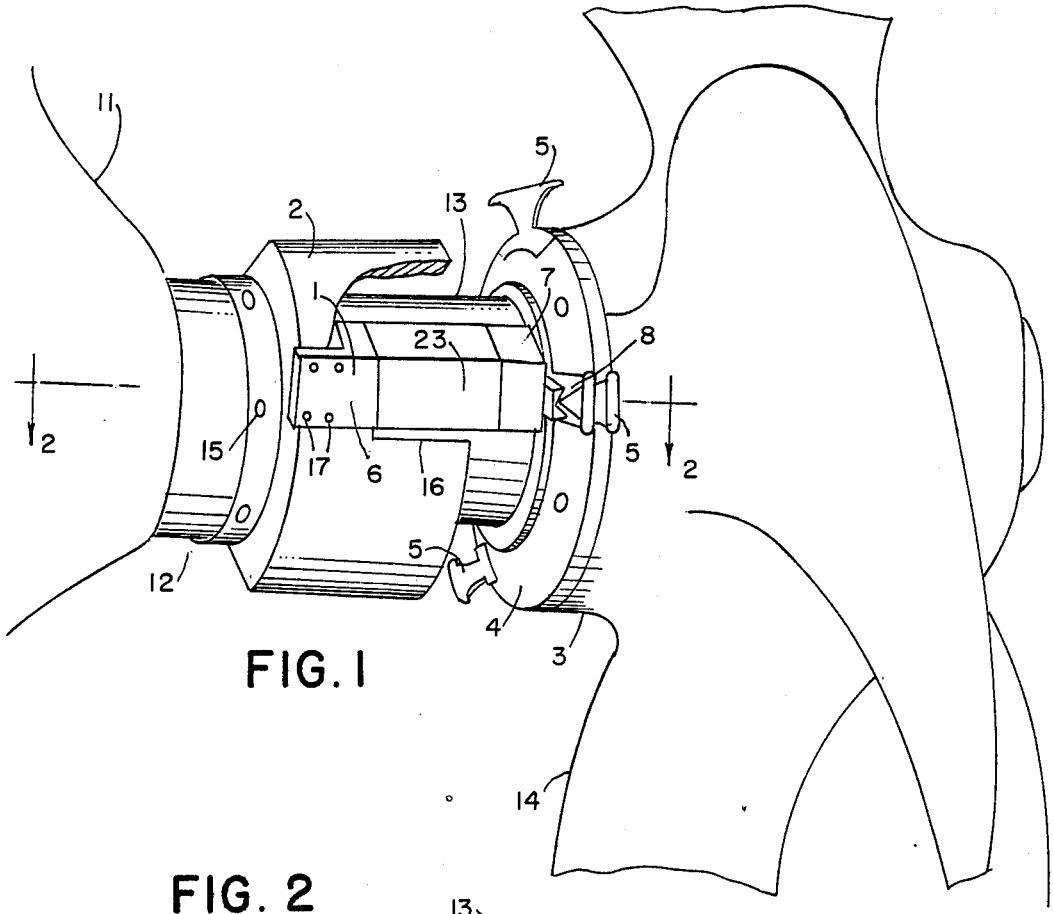
FIG. 1
FIG. 2
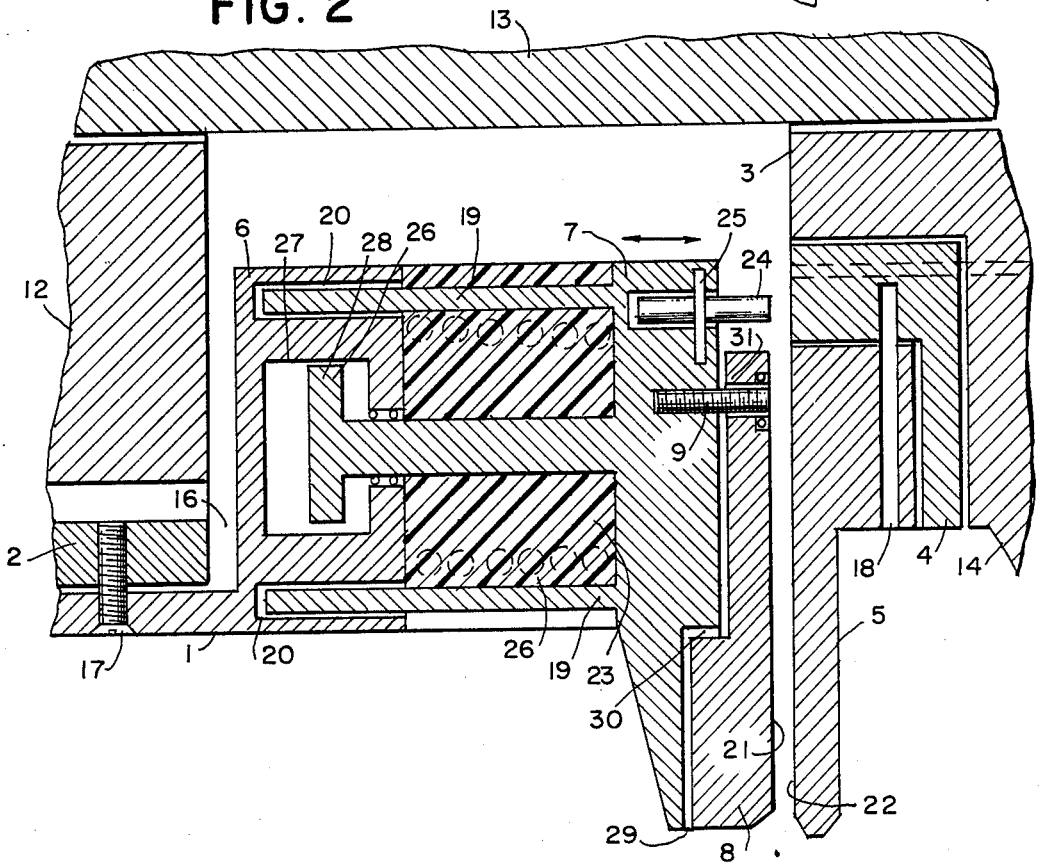

LINE CUTTER FOR PROPELLERS

BACKGROUND OF THE INVENTION

1. Field of the Invention

This invention relates to devices that cut underwater lines, weeds, nets and the like and more particularly to shearing cutters that include a blade rotating with the shaft and propeller of a vessel that cooperates with a blade mounted on a non-rotating portion of a vessel adjacent the shaft with means for controlling the distance between rotating and non-rotating blades.

2. Description of the Prior Art

U.S. Pat. Nos. 4,447,215; 4,507,091, 4,544,363 and 4,801,281 have been issued to the inventor for propeller protecting devices that carry both a rotary cutter blade assembly and a stationary blade assembly on the rotating shaft or propellers of a boat. The rotary cutter blade assembly is fixedly connected to the rotating part and the stationary blade assembly is rotatably held in a fixed axial position relative to the rotating blades by bearing means and a flexible connection to the non-rotating part of the boat such as the strut or propeller shaft housing.

This bearing means is a source of wear, vibration and noise since it is continuously exposed to underwater debris, abrasive sand and fouling by marine organisms. Maintenance of the bearing is a minor problem for small boats that are frequently hauled out of the water. However, large commercial vessels that are in almost constant operation for prolonged periods are confronted with serious expense if the bearing must be serviced.

When a propeller is pushing a vessel forward in the water, the propeller and shaft exert a great forward force on the hull on a line coincident with the long axis of the shaft. This tends to move the shaft forward into the shaft housing. When in reverse, the axial movement is in the opposite direction. Thrust bearings take up the force and limit this axial movement. Temperature changes in the shaft also cause axial movement. When both the rotating and stationary blade assemblies are mounted at a common point on the shaft, the axial movement of the shaft does not effect the spacing between the two assemblies. However, when the rotating blade assembly is mounted on the shaft and the stationary blade assembly is mounted on the hull, then some mechanism must be provided to maintain a spacing between the blades close enough for shearing despite these axial movements. That mechanism must respond slowly to the axial movement to avoid moving away abruptly at the moment the moving blade and the stationary blade engage a foreign object for shearing action. A secondary mechanism that tends to bring the blades together at the moment of engaging the foreign object would further enhance the shearing action.

SUMMARY OF THE INVENTION

It is, accordingly, an object of the invention to provide an assembly that includes a rotating blade means for affixing to the rotating shaft or propeller of a waterborn vessel and a stationary blade means for connecting to a non-rotating portion of the vessel close to the shaft such as the propeller shaft housing or strut. It is another object to provide positioning means for maintaining the spacing between rotating and stationary blades so close as to provide a shearing action without forcing the blades together. It is yet another object to provide a time delay to the positioning action to prevent a foreign object held between the blades from causing the positioning action to separate the blades before shearing can be achieved. It is yet another object to provide a secondary positioning mechanism that tends to bring the blades together at the moment of engaging the foreign object to further enhance the shearing action.

The rotary blade assembly includes a ring that encircles the shaft. This ring may be fixed to the shaft or to the propeller. Extending radially from the ring are one or more blades having a shearing plane perpendicular to the axis of the shaft.

The stationary blade assembly includes:

(1) a base for affixing the stationary blade assembly to the shaft housing or strut;

(2) a stationary blade having a shearing plane parallel to the shearing plane of the rotating blade; and (3) positioning means for holding the stationary blade in shearing position closely approximated to the rotating blade despite axial movement of the shaft relative to the vessel.

The positioning means includes:

(A) sensing means for sensing the distance between moving and stationary blades;

(B) primary moving means for moving the stationary blade toward or away from the rotating blade in response to the sensing means;

(C) retarding means for preventing rapid movement of the moving means; and (D) secondary moving means for rapidly approximating the stationary blade to the rotating blade in response to engagement of a foreign object between the stationary and rotating blades.

The sensing means may be any one of the well known sensors including a rotating contact wheel or a non-contacting proximity sensor such as a Hall effect magnetic detector or magnetic reed switches. The primary moving means may be any one of the well known moving means such as spring, pneumatic, hydraulic, electric drive mechanisms or combinations thereof with retarding means including restrictive fluid flow paths and electric time delays well known in the art.

The secondary moving means includes a pivoting stationary blade with a wedge interacting with an inclined plane to force it toward the rotary blade when a foreign object between the blades applies a rotary force to the stationary blade causing it to pivot about its support.

There may be situations in which it is useful to retract the blades. An alternative embodiment applicable to those situations may include means for retracting the blades centripetally when not in use and for extending the blades centrifugally when required for line shearing operation.

These and other objects, advantages and features of the invention will become more fully apparent when the following detailed description of preferred embodiments of the invention are read in conjunction with the accompanying drawings.

BRIEF DESCRIPTION OF THE DRAWINGS

FIG. 1 is a perspective view of the cutter of the invention with a rubber moving means with hydraulic damper in place on a ship.

FIG. 2 is a partial sectional view taken on line 2—2 of FIG. 1, greatly enlarged.

DETAILED DESCRIPTION OF PREFERRED EMBODIMENTS

Figure 7:
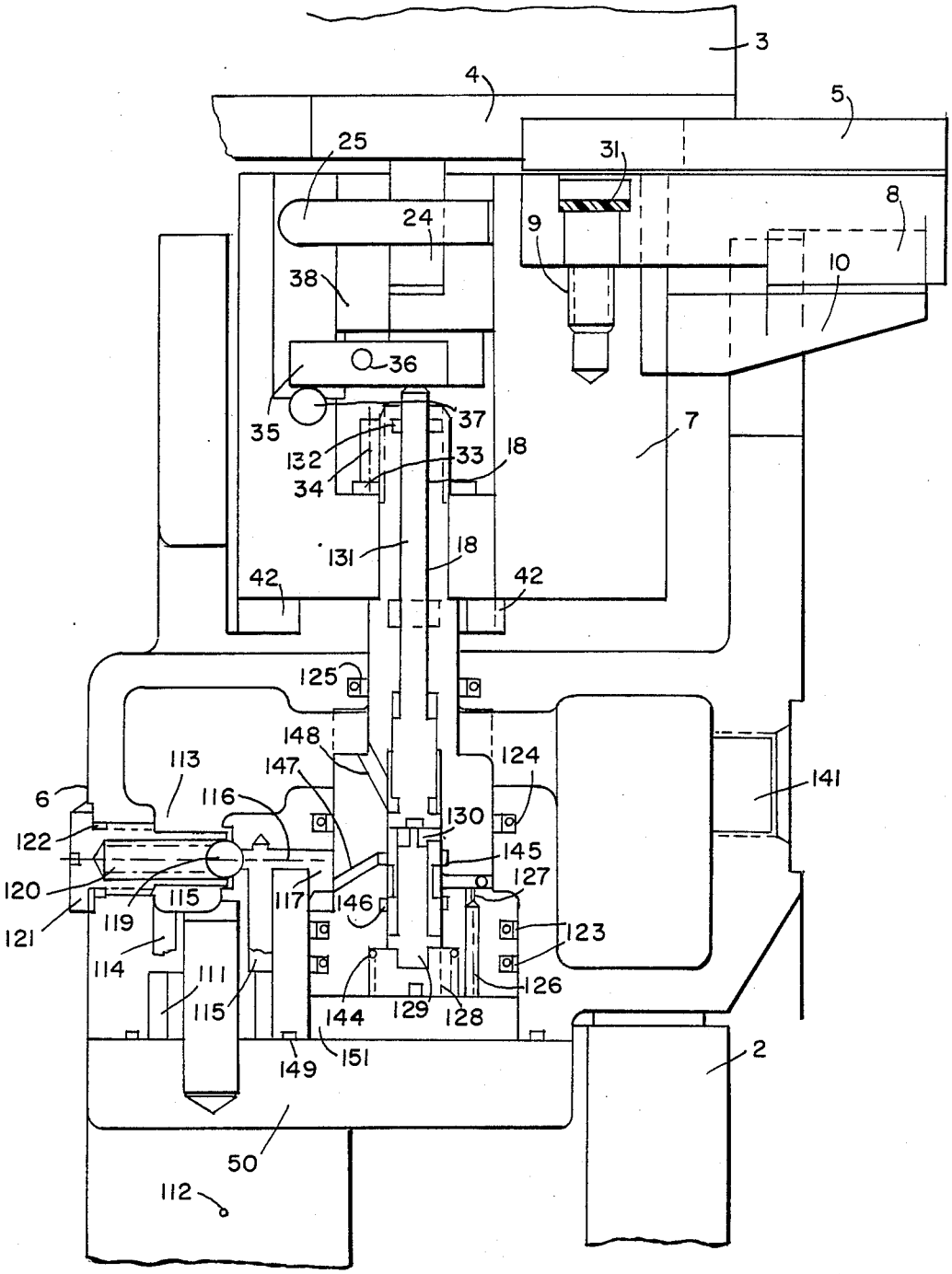
FIG. 7 is a sectional view of an alternative embodiment of the invention employing a hydraulic system with a motor driven hydraulic pump.

Referring now first to the embodiment shown in FIGS. 1 and 2, a vessel 1 has a propeller shaft housing 12, and a propeller shaft 13 journalled therein with a propeller hub 3 carrying propeller 14 affixed to the shaft. A rope guard 2 surrounds the shaft and is secured to the housing 12 by bolts 15. A notch 16 in the rope guard receives the stationary blade assembly 1 which is bolted to the rope guard by bolts 17. A blade support ring 4 is bolted to the propeller hub 3. Rotary blades 5 are bolted to the ring 4 by bolts 18 so that they extend radially beyond the hub 3. This positions the blades so that they catch the foreign matter as they turn and tend to twist it inward where it will be caught and sheared against the non-rotating blade 8. Blade 8 is held radially extended with its flat shearing plane parallel to the flat shearing plane of the rotating blades by blade support assembly 1. Stationary blade support assembly 1 includes a metal base portion 6 bolted to the rope guard 2 and a blade holder 7 that has a controlled fore-and-aft axial motion parallel to the axis of the shaft. Guide rods 19 move in recesses 20 in base 6 to maintain the shearing face 21 of non-rotating blade 8 parallel to the shearing face 22 of rotating blade 5. As shown, a rubbery block 23 of polyurethane plastic separates the base 6 from the blade holder 7 and provides spring bias forcing the blade 8 against the blade 5. A roller 24 rotatably supported in blade holder 7 by axle 25 is forced against the rotating blade support ring 4. When contact is made, the two blades are kept apart at an optimal distance, found to be 0.005 inches in one case. The roller acts as a mechanical sensor that maintains this distance between blades despite axial movement of the propeller. When the propeller moves forward, the roller 24 forces blade holder 7 forward, compressing the block 23. When propeller is reversed, it moves backward increasing blade separation, but compressed block 23 expands until roller 24 again contacts ring 4. The roller is shown away from its contact with the ring for illustrative purposes. As an alternative to a rubbery block, other means of providing spring bias for blade moving may be provided such as a coil spring 26, shown in phantom in FIG. 2. To prevent the foreign matter trapped between the blades from pushing blade 8 forward before shearing can take place, a velocity reduction, damper, or retarding means is provided, shown in FIG. 2 as a hydraulic piston 27 in a cylinder 28 containing a fluid 29 that resists sudden motion. This primary blade positioning means is supplemented by a secondary blade moving means that forces the two blades closer together at the moment foreign matter is caught between rotating and stationary blades. The torque from the rotating blade is transmitted through the foreign matter to the stationary blade. The stationary blade 8 is supported on blade holder 7 by a pivot pin 9. Blade 8 pivots about pin 9 under the influence of the torque transmitted through the foreign matter. Blade 8 has a wedge element on its forward face with the narrow edge of the wedge 29 facing forward and extending perpendicular to the axis of the pivot pin. In registry with the wedge is a rear opening, wedge-shape recess 30 in the blade holder 7, better seen in FIGS. 3, 4. As blade 8 pivots about pin 9, an inclined plane action of the wedge 29 against the sloping side of recess 30 causes blade 8 to be forced toward blade 5. The axial movement will be very small but it occurs at just the moment when it is needed. The small amount of axial movement may be provided through flexing of blade 8 or other means such as a resilient washer 31 under the head of the pivot pin. (FIGS. 2, 7)

Figure 3:
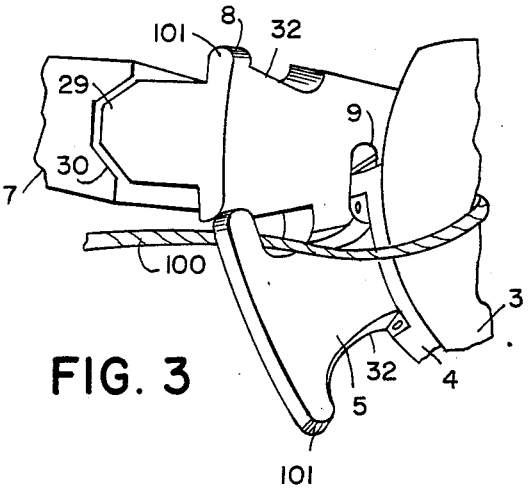
FIG. 3 is a partial perspective view of the two blades in shearing position.
Figure 4:
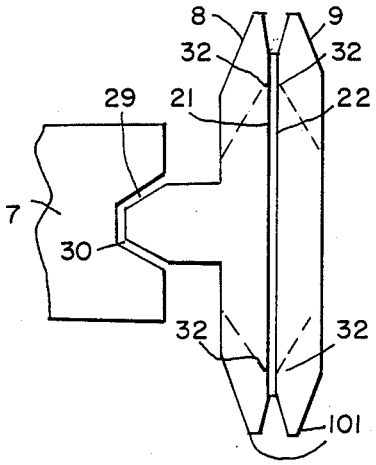
FIG. 4 is a side elevation detail of the juxtaposed blades.

Referring now to FIGS. 3 and 4 for details of the two shearing blades, each blade has a flat shearing face 21 and 22 and lateral edges 32 sharp at the shearing faces to provide a scissors like action on the rope 100 caught between. Each blade is narrow at the base and wider at the outer portion, terminating in ears 101. The tapering sides tend to pull the rope toward the shaft, to enhance engagement while shearing. Each ear 101 has an inner ramp portion 102 that forces blades apart before shearing edges meet in case of malposition of the blades.

Figure 5:
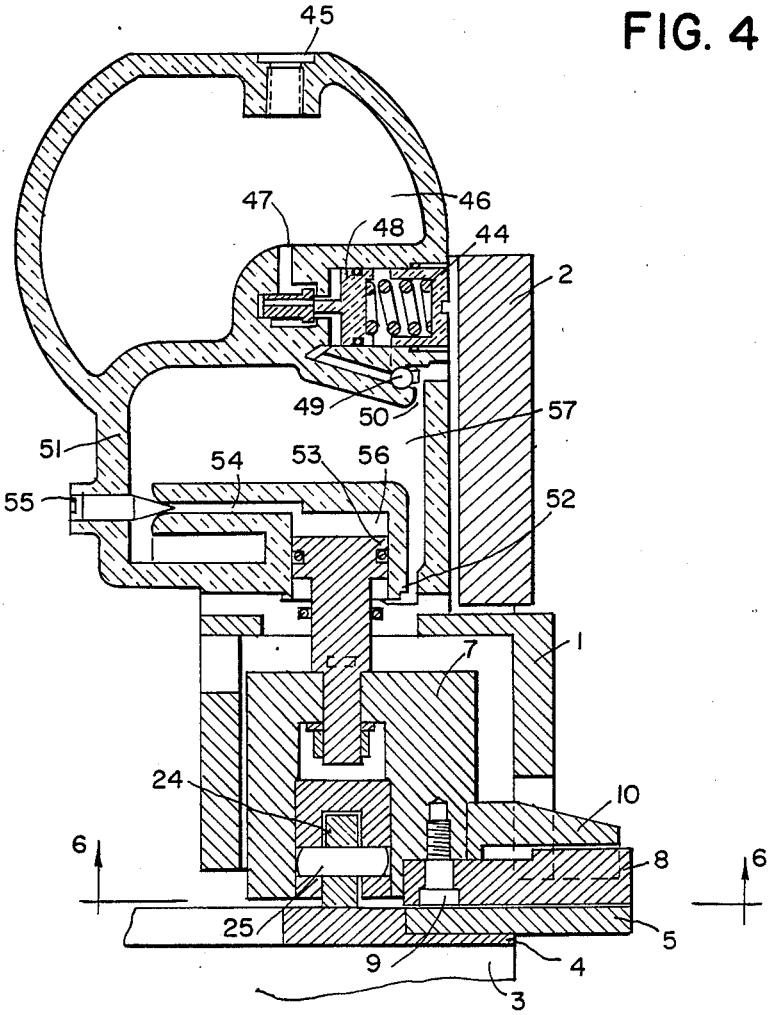
FIG. 5 is a sectional view of an alternative embodiment of the invention employing compressed air and hydraulic moving means.
Figure 6:
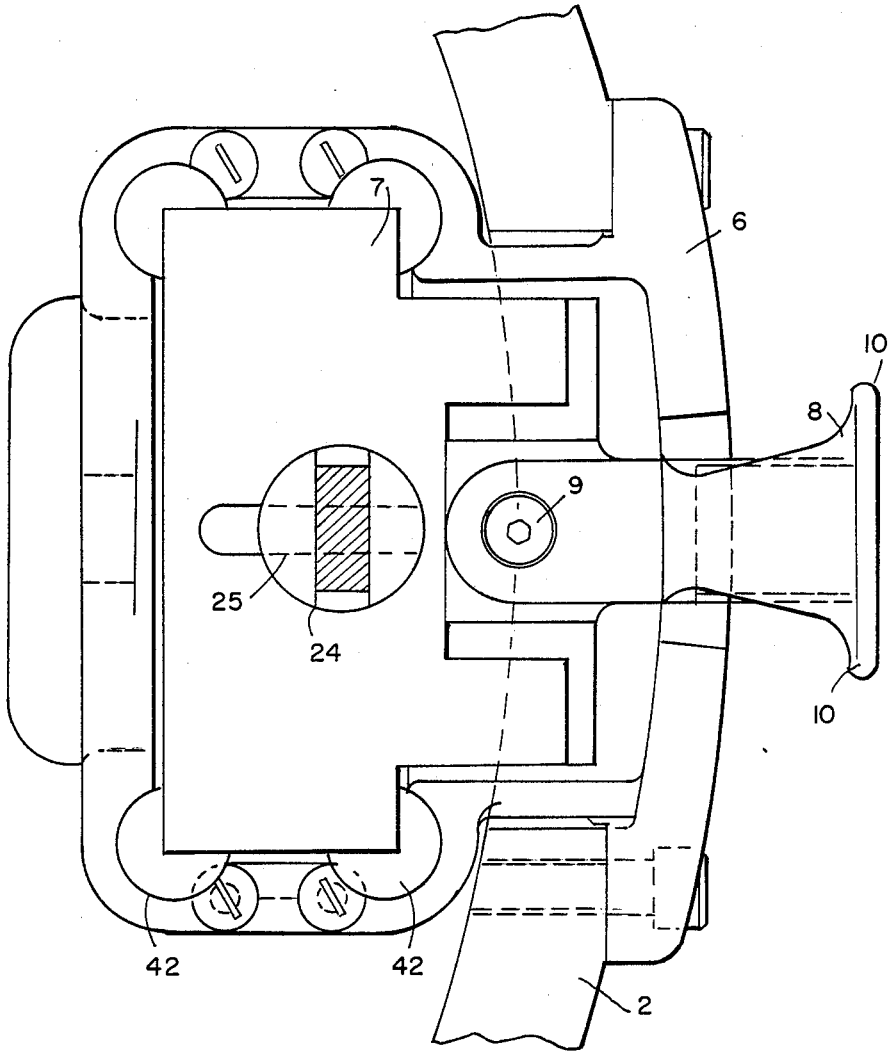
FIG. 6 is a sectional view taken on line 6—6 of FIG. 5.

FIGS. 5 and 6 illustrate an embodiment of the invention with hydraulic moving means, a mechanical roller sensing means and a pneumatic pressure reservoir for maintenance of hydraulic pressure.

The apparatus consists of a rotary cutter ring 4 having replaceable cutter blades 5 and attached to the face of the propeller hub 3, with stationary blade unit assembly 1 being fixably mounted to the rope guard 2 in a working proximity to the rotating cutter blades 5.

The stationary blade unit 1 is made up of the following: A base portion 6 that bolts onto rope guard 2; has slide bearings 42, held in place by screw 43. Mounted in bearings 42 is a slideably mounted stationary cutter block 7, attached to which is pivotable blade or blades 8, blade pivot and attachment screw 9, blade wedge block 10 which limits the lateral swing of the blade 8, and locater roller bearing 24.

Control assembly 51 having a fluid motor such as a hydraulically pressurized cylinder 52, having a piston and rod assembly 53 which is mechanically attached to the cutter block 7. A conduit 54 having a flow control unit 55 at its entrance to the piston chamber 56, connects the fluid motor to an air over hydraulic accumulator chamber 57. A second conduit 50 attached to the air end of the accumulator 57, having a check valve 49 at its entrance to the accumulator 57, connects the accumulator 57 to a pressure regulator 48. A third conduit 47 attaches the regulator 48 to a high pressure air receiver tank 46 and a high pressure fill valve 45 to charge the receiver or reservoir.

The high pressure receiver 46 is the energy source for the operation of the positioning apparatus. Dependent on the size of this unit and the charged pressure level, it can provide many months of operation before requiring a recharge. The pressure regulating valve 48 will supply a low pressure to the accumulator 57 and only permit flow when the accumulator pressure is lower than its set-point as determined by the setting of control spring 44.

Approximately 50% of the accumulator volume, all of the first conduit and the cylinder piston chamber are to be charged with hydraulic fluid. The air receiver tank is to be charged with high pressure air or nitrogen.

The roller bearing will ride against the rotating blade ring to maintain a fixed relationship between the rotating and stationary blade surfaces. When axial movement of the propeller occurs, the pressurized hydraulic cylinder (fluid motor) 52 will move the slideably mounted stationary blade block 7 along slide bearings 42 to maintain blade relationship. Should the propeller move axially toward the stationary blade block, fluid will flow out of the cylinder 52 through the flow control unit 55 and the first conduit 54 into the accumulator 57. As the second conduit 50 is fitted with a check valve 49, pressure in the accumulator 57 will rise slightly as the fluid volume entering through the first conduit will cause the air in the chamber to compress. The check valve 49 will protect the regulating valve 48 against the higher back pressure which could shorten its useful life. To maintain blade position during the high shock loading when a mooring line or other material is cut by the blades, the flow control 55 orifice will retain the fluid in the cylinders 52 momentarily and will also protect the other components from the resultant high pressure shock wave.

An alternative embodiment of the invention, illustrated in FIG. 7 employs hydraulic moving means with an electric motor driven pump and a mechanical sensor.

The apparatus consists of a rotary cutter ring 4 having replaceable cutter blades 5 and attached to the face of the propeller hub 3, with stationary blade unit assembly 1 being fixably mounted to the rope guard 2 in a working proximity to the cutter blades 5.

The stationary blade unit assembly 1 is made up of: stationary cutter block 7, attached to which is pivotable cutter blade or a multiplicity of blades 8, blade pivot and attachment screw 9, and blade wedge block 10 which limits the lateral swing of blade 8, and the roller assembly consisting of carrier 38, roller 24, axle 25, ratio lever 35, pivot pin 36 and pivot ball 37. The block assembly is slideably mounted into the base portion on bearings 42 and attached to piston 18 by means of washer 33 and nut 34.

Piston assembly 18 includes valve 131, spool valve 130, valve spring 129, valve retainer 128, seals 123, 132 and 144, and conduits 126, 147, 148, adjustable orifice 27, grooves 45 and 46 for fluid passage.

Housing 6 also includes fluid pressure pump 111, pressure conduits 115 and 116, piston and rod seals 124 and 125, pressure unloading valve 119, pressure setting spring 120, retainer 121 with seal 122, fluid sump 113, pump supply conduit 114, face seal 149 and sump vent port 141.

Detachable cover 150 includes electrical pump drive motor 112 with its appropriate seals for protection from the sea water. A vent tube should be attached at port 141 and be of sufficient length to be protected from water entry, and be fitted with a suitable breather filter. Electrical cable for pump drive to be suitably connected to an environmentally protected ON-OFF switch assembly. Sump chamber 113 is to be filled with hydraulic fluid.

When switch is turned ON, pump 111 will operate to supply hydraulic fluid under pressure (as set by unloading valve 119 and spring 120) through conduits 115 and 116 into piston chamber 117. Fluid under pressure will enter piston 18 through conduit 147 and groove 145 to valve 130. If spool land is not covering groove 145, fluid will be permitted to enter conduit 126 through orifice 127 into piston head chamber 151. Due to the difference of piston areas, the piston will stroke to extend the piston rod and cutter block towards the rotating blade ring. When both lands of spool 130 are aligned with the center edges of grooves 145 and 146, fluid flow will be cut off and further movement of piston and cutter block will be stopped.

When the propeller is rotating in the Ahead direction, the resultant power thrust may cause the propeller and rotating blade assembly to move axially in the direction of the stationary blade assembly. Due to this movement, the position relationship between rotary and stationary blades will change. Roller 24 will move with the rotary blades and through the ratio of the pilot lever 35 will multiply the movement acting on valve plunger 131 to move valve 130 quickly towards the piston head to open chamber 151 through conduit 126 and variable control orifice 127 to the sump 113 through conduit 148. Should a net, line or other material be ingested into the propeller area, the rotating blades will gather it and carry it to the stationary blade where it will be cut and carried away by the water flow created by the propeller. In the process of cutting the material, a shock loading is absorbed by the blades which will have a tendency to move them apart. To minimize this reaction, control orifice 127 will restrict the flow of fluid from the piston chamber 151 thereby maintaining the blades relationship to each other. When the propeller is rotating in the Astern direction, the power thrust may cause the propeller and rotating blade ring to move axially in the direction away from the stationary blade. Due to the valve spring 129, the roller and carrier will follow. Lever 35 will rotate on its pivot 36 to quickly open valve 130 to conduit 148 and groove 145 to permit fluid under pressure to enter piston chamber 151 through conduit 128 and control orifice 126. This will cause piston 18 to exert a force on the stationary cutter block 7 which will move to maintain the blade position relationship required to provide the optimum efficiency of the antifouling gear. Consequently, any axial movement of the propeller and rotating blade ring will cause the same axial movement in the stationary blade assembly, thereby reacting to correct the blade relationship regardless of direction or power level acting on the propeller.

Figure 8:
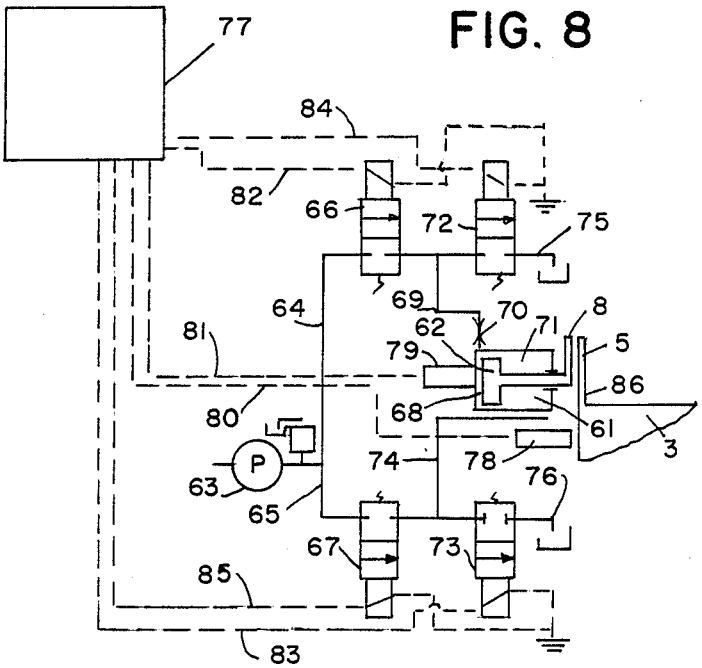
FIG. 8 is a diagrammatic view of a hydraulic moving means of the invention with electronic control.

An alternative embodiment of the invention, illustrated diagrammatically in FIG. 8, employs electronic sensing and control means and hydraulic moving means for correct positioning of the non-rotating blade.

The power to move the non-rotating blade 8 is provided by hydraulically pressurized cylinder 61 having a piston and rod assembly 62 that is mechanically attached to blade 8. Hydraulic fluid under pressure is supplied by remotely located pump 63 through conduits 64 and 65 to electrically operated two way valves 66 and 67. The piston end, chamber 68, of cylinder 61 is connected to both valves 66 and 72 through conduit 69 and orifice 70. The rod end, chamber 71 of cylinder 61 is connected to both valves 67 and 73 through conduit 74. Valves 72 and 73 are connected to the hydraulic fluid tank by means of conduits 75 and 76.

Blade position is monitored by electronic proximity sensors 78 and 79, each of which is reading its position in relation to its specific target. In this case, sensor 78 is reading its position in relation to the rotating blades 5 attached to propeller hub 3, while sensor 79 is reading its position in relation to the piston and rod assembly 62. Both sensors are immovably mounted relative to the hull. When the blades 5 and 8 are set in their correct shearing relationship to one another, both sensors will be equidistant from their respective targets and will generate signals of equal amplitude.

Both sensors are connected to control cabinet 77 by cables 80 and 81. Electrical power is turned on to supply control cabinet 77 and run hydraulic pump 63. A power supply panel located in the control cabinet will regulate the voltage and control power surge to protect the electronic circuitry. The sensors 78 and 79 are reading their respective targets and developing a voltage or current output signal which is transmitted to the electronic circuit board through cables 80 and 81. The signal levels from sensors 78 and 79 will be compared electronically and if a mismatch occurs, a signal will be generated and directed to either cables 82 and 83 or cables 84 and 85 to open valves 66 and 73 or valves 72 and 67 which will cause cylinder 61 to either extend or retract respectively.

When the propulsion machinery is operating in the Ahead mode, the thrust of the propeller will cause the hub and rotating blades 5 to move towards sensor 78. As this occurs, the sensor output signal will change which will immediately be compared to the output signal of sensor 79 and due to this error in the compared signals, a new signal will be developed and directed through cables 85 and 86 to operate valves 67 and 69 to send hydraulic fluid under pressure to the chamber 71 of cylinder 61 through conduit 74, and permit hydraulic fluid from chamber 68 of cylinder 61 to go to tank through conduits 69 and 75. The non-rotating blade 8 will thus be moved axially to maintain its relative position with the rotating blades 5. Any increase in thrust that is intense enough to initiate further axial movement of the hub will result in further retraction of the piston-rod assembly 62 and non-rotating blade 8 to maintain the proper working clearance between the blade sets. When the propulsion machinery is operating in the Astern mode, the propeller thrust will cause the hub 3 and blade ring 86 to move away from the hub sensor 78. This will result in a voltage or current change which when compared by the electronics will initiate a signal through cables 82 and 83 to turn on valves 66 and 73. Hydraulic fluid under pressure will be directed through valve 66 and orifice 70 to chamber 68 of cylinder 61 via conduits 64 and 69, and at the same time chamber 7 of cylinder 61 will be connected to the fluid tank via conduits 74 and 76 through valve 73. Piston-rod assembly 62 and non-rotating blade 8 will move axially to maintain its relative position with blade ring 86. When the hub and blade ring 86 stop their axial travel and the sensor signals again equalize, valves 66 and 73 will close thereby locking the non-rotating blade 8 in its new position.

Orifice 70 provides two primary functions and is positioned at the piston end of cylinder 61 which sees the greatest fluid flow during operation. The first function of orifice 70 is to control the operating speed of the cylinder, and the second vital function when a line, net or weed contacts the blades 15 is localizing the resulting shock within the chamber 68 of the cylinder 61.

Figure 9:
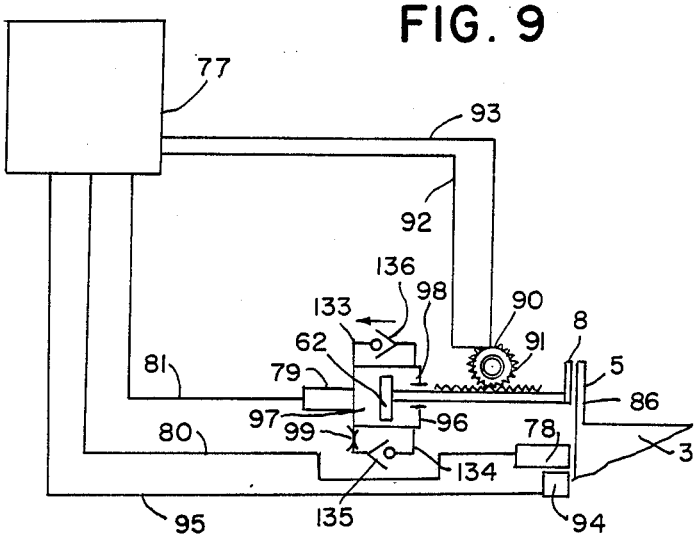
FIG. 9 is a diagrammatic view of an electrical moving means of the invention with electronic control.

In an alternative embodiment of the invention illustrated diagrammatically in FIG. 9, two electronic proximity sensors 78 and 79 sense positions of rotary ring 86 and piston assembly 62 respectively and feed signals to electrical control 77 to maintain equal spacing of their two targets as in the mechanism described above for FIG. 8 with a reversible gearmotor 90 providing the moving force for moving piston assembly 62 back and forth through rack and pinion drive 91. Appropriate controlling power for the moving means are supplied through cables 92 and 93 to adjust piston 62 and blade 8 to correct position for shearing action between the blades. A third sensor 94 senses rotation of the ring 86 and sends a signal via wire 95 to control 77. Control 77 sends power to gearmotor 90 causing clockwise rotation that moves blade 8 away from blade 5 when sensor 94 indicates that rotation has stopped. This mechanism ensures adequate spacing between the blades when starting Ahead. Piston 62, moving in hydraulic cylinder 96 forces hydraulic fluid between forward chamber 97 and rear chamber 98 through conduits 133 and 134. Check valves 136 and 135 cause fluid to flow through conduit 133 when piston 62 moves toward the propeller and through conduit 134 when piston 62 moves away from the propeller. Constriction 99 reduces flow through conduit 134 so that blade 8 cannot move away rapidly from blade 5 when shearing takes place.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An apparatus that cuts foreign matter including lines, wires, nets and weeds of the type that may be encountered by propeller driven vessels when under way, said vessels of the type where the propeller is mounted to a rotatable propeller shaft that extends from a propeller shaft housing connected to the vessel's hull, said apparatus comprising:

(A) at least one first blade means having a first shearing plane, said first blade means arranged to rotate in conjunction with said propeller with said first shearing plane substantially perpendicular to the axis of said shaft;

(B) first support means for supporting said first blade means in position extending radially and beyond said first support means to engage said foreign matter, said first support means including means for fixedly attaching to at least one member of the pair consisting of said shaft and said propeller;

(C) at least one second blade means having a second shearing plane, said second blade means arranged with said second shearing plane substantially parallel to said first shearing plane of said first blade means;

(D) second support means for supporting said second blade means in a position extending radially parallel to said first blade means to engage said foreign matter for shearing said foreign matter between said first and second blade means, said second support means for fixedly attaching to a non-rotating member of said hull;

(E) primary moving means incorporated in said second support means for moving said second blade means toward and away from said first blade means to maintain said first and second shearing planes in close proximity for shearing operation;

(F) control means operatively connected to said primary moving means, said control means including sensing means for sensing the distance between said first and second shearing planes, said control means controlling said primary moving means to maintain a particular spacing between said shearing planes despite axial movement of said propeller; and (G) secondary moving means connected to said second support means, said secondary moving means for moving said second blade means toward said first blade means when said foreign matter is caught between said blades and torque is transmitted from rotation of said first blade means through said foreign matter to said second blade means, said secondary moving means converting said torque into motive power forcing said blades closer together to overcome forces tending to separate said blades at the moment of shearing.

2. The apparatus according to claim 1, in which said primary moving means includes velocity retarding means for slowing the movement of said second blade means away from said first blade means to prevent said foreign matter from causing opening of said spacing at the moment of shearing.

3. The apparatus according to claim 2, in which said velocity retarding means is hydraulic.

4. The apparatus according to claim 3, in which said primary moving means includes a spring bias.

5. The apparatus according to claim 3, in which said secondary moving means includes a pivot means connecting said second blade means to said second support means said pivot means arranged to permit limited rotation of said second blade means about said pivot means under the force of said torque, and further including wedge means for converting said limited rotation into axial movement.

6. The apparatus according to claim 2, in which said primary moving means includes electrical apparatus.

7. The apparatus according to claim 6, in which said sensing means is mechanical.

8. The apparatus according to claim 6, in which said sensing means includes electrical apparatus.

9. The apparatus according to claim 2, in which said primary moving means includes a spring bias.

10. The apparatus according to claim 2, in which said secondary moving means includes a pivot means connecting said second blade means to said second support means said pivot means arranged to permit limited rotation of said second blade means about said pivot means under the force of said torque, and further including wedge means for converting said limited rotation into axial movement.

11. The apparatus according to claim 1, in which said primary moving means is hydraulic.

12. The apparatus according to claim 11, in which said sensing means is mechanical.

13. The apparatus according to claim 12, in which said secondary moving means includes a pivot means connecting said second blade means to said second support means said pivot means arranged to permit limited rotation of said second blade means about said pivot means under the force of said torque, and further including wedge means for converting said limited rotation into axial movement.

14. The apparatus according to claim 11, in which said sensing means includes electrical apparatus.

15. The apparatus according to claim 11, in which said secondary moving means includes a pivot means connecting said second blade means to said second support means said pivot means arranged to permit limited rotation of said second blade means about said pivot means under the force of said torque, and further including wedge means for converting said limited rotation into axial movement.

16. The apparatus according to claim 1, in which said primary moving means includes electrical apparatus.

17. The apparatus according to claim 16, in which said sensing means is mechanical.

18. The apparatus according to claim 16, in which said sensing means includes electrical apparatus.

19. The apparatus according to claim 1, in which said primary moving means includes a spring bias.

20. The apparatus according to claim 1, in which said secondary moving means includes a pivot means connecting said second blade means to said second support means said pivot means arranged to permit limited rotation of said second blade means about said pivot means under the force of said torque, and further including wedge means for converting said limited rotation into axial movement.

21. An apparatus that cuts foreign matter including lines, wires, nets and weeds of the type that may be encountered by propeller driven vessels when under way, said vessels of the type where the propeller is mounted to a rotatable propeller shaft that extends from a propeller shaft housing connected to the vessel's hull, said apparatus comprising:

(A) at least one first blade means having a first shearing plane, said first blade means arranged to rotate in conjunction with said propeller with said first shearing plane substantially perpendicular to the axis of said shaft;

(B) first support means for supporting said first blade means in position extending radially and beyond said first support means to engage said foreign matter, said first support means including means for fixedly attaching to at least one member of the pair consisting of said shaft and said propeller;

(C) at least one second blade means having a second shearing plane, said second blade means arranged with said second shearing plane substantially parallel to said first shearing plane of said first blade means;

(D) second support means for supporting said second blade means in a position extending radially parallel to said first blade means to engage said foreign matter for shearing said foreign matter between said first and second blade means, said second support means for fixedly attaching to a non-rotating member of said hull;

(E) moving means incorporated in said second support means for moving said second blade means toward and away from said first blade means to maintain said first and second shearing planes in close proximity for shearing operation; and (F) control means operatively connected to said moving means, said control means including sensing means for sensing the distance between said first and second shearing planes, said control means controlling said moving means to maintain a particular spacing between said shearing planes despite axial movement of said propeller.

22. The apparatus according to claim 21, in which said moving means includes velocity retarding means for slowing the movement of said second blade means away from said first blade means to prevent said foreign matter from causing opening of said spacing at the moment of shearing.

23. The apparatus according to claim 22, in which said velocity retarding means is hydraulic.

24. The apparatus according to claim 23, in which said moving means includes a spring bias.

25. The apparatus according to claim 22, in which said moving means includes electrical apparatus.

26. The apparatus according to claim 25, in which said sensing means is mechanical.

27. The apparatus according to claim 25, in which said sensing means includes electrical apparatus.

28. The apparatus according to claim 22, in which said moving means includes a spring bias.

29. The apparatus according to claim 21, in which said moving means is hydraulic.

30. The apparatus according to claim 29, in which said sensing means is mechanical.

31. The apparatus according to claim 29, in which said sensing means includes electrical apparatus.

32. The apparatus according to claim 21, in which said moving means includes electrical apparatus.

33. The apparatus according to claim 32, in which said sensing means is mechanical.

34. The apparatus according to claim 32, in which said sensing means includes electrical apparatus.

35. The apparatus according to claim 21, in which said moving means includes a spring bias.

* * * * *